United States Patent [19]

Fletcher-Jones

[11] Patent Number: 4,989,559

[45] Date of Patent: Feb. 5, 1991

[54] PISTONS FOR INTERNAL COMBUSTION ENGINES

[75] Inventor: David F. Fletcher-Jones, Burley, England

[73] Assignee: Wellworthy Limited, Manchester, England

[21] Appl. No.: 417,073

[22] Filed: Oct. 4, 1989

[30] Foreign Application Priority Data

Oct. 15, 1988 [GB] United Kingdom ..... 8824222

[51] Int. Cl.[5] ..... F02F 3/00

[52] U.S. Cl. ..... 123/193 P; 92/189; 92/190

[58] Field of Search ..... 123/193 P; 92/189, 190

[56] References Cited

U.S. PATENT DOCUMENTS

| | | | |
|---|---|---|---|
| 1,761,141 | 6/1930 | McCoy | 92/190 |
| 4,292,937 | 10/1981 | Vallaude | 123/193 P |
| 4,674,399 | 6/1987 | Bruni | 123/193 P |

FOREIGN PATENT DOCUMENTS

| | | | |
|---|---|---|---|
| 2949091 | 6/1981 | Fed. Rep. of Germany | 123/193 P |
| 0674423 | 1/1930 | France | 92/190 |
| 2200718 | 8/1988 | United Kingdom | 123/193 P |

*Primary Examiner*—Andrew M. Dolinar
*Assistant Examiner*—M. Macy
*Attorney, Agent, or Firm*—William R. Hinds

[57] ABSTRACT

Pistons are described comprising a crown having an associated piston ring groove belt and which crown is supported by gudgeon pin bosses connected thereto by two generally axially extending planar webs which are orientated transversely to the gudgeon pin axis and also supported by at least one subsidiary support rib associated with each planar web and pin boss and which support rib extends in a generally axial direction between the crown underside and pin boss and generally transversely to the planar web. The piston may be of either articulated or monometal construction.

10 Claims, 2 Drawing Sheets

PISTONS FOR INTERNAL COMBUSTION ENGINES

The present invention relates to pistons for internal combustion engines.

According to the present invention a piston for an internal combustion engine comprises a crown having an associated piston ring groove belt and which crown is supported by gudgeon pin bosses connected thereto by two generally axially extending planar webs which are oriented transversely to the gudgeon pin axis and also supported by two subsidiary support ribs associated with each planar web and pin boss and which support ribs lie on the radially outer faces of the planar webs and extend in a generally axial direction from the crown underside and generally transversely to the planar webs.

The two planar webs may furthermore be connected by one or more generally axially extending ribs extending therebetween and also supporting the underside of the crown at the ribs top edge. Where one rib is used it may lie in the plane which includes both the piston axis and the gudgeon pin axis. Where two ribs are used, these may be disposed about the plane which includes both the gudgeon pin axis and piston axis.

The piston crown may also include a combustion bowl in the case, for example, of a direct injection diesel engine.

The piston structure described may be utilized in a monometal piston having integral skirt portions depending from and supported, for example, by extensions of the planar webs. Alternatively, the structure described may be part of an articulated piston construction having a separate skirt portion and articulated to the crown portion by means of a common gudgeon pin.

The piston of the present invention may be manufactured in the form of a machined steel, cast-iron or aluminium alloy casting.

In order that the present invention may be more fully understood examples will now be described by way of illustration only with reference to the accompanying drawings, of which:

Figure 1:
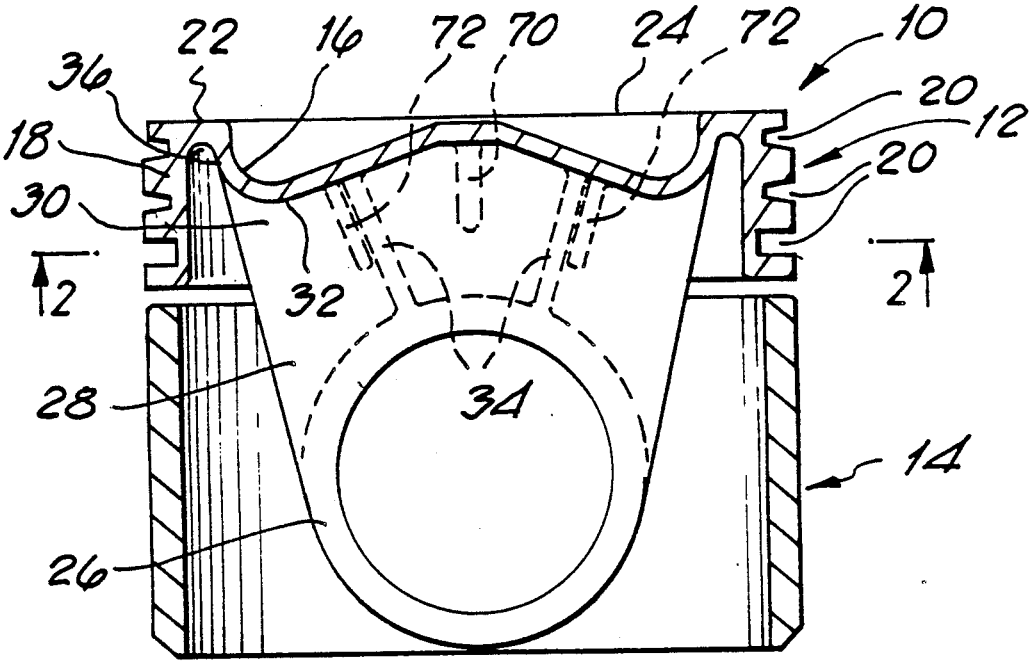
FIG. 1 shows a section through an articulated piston according to the present invention.
Figure 2:
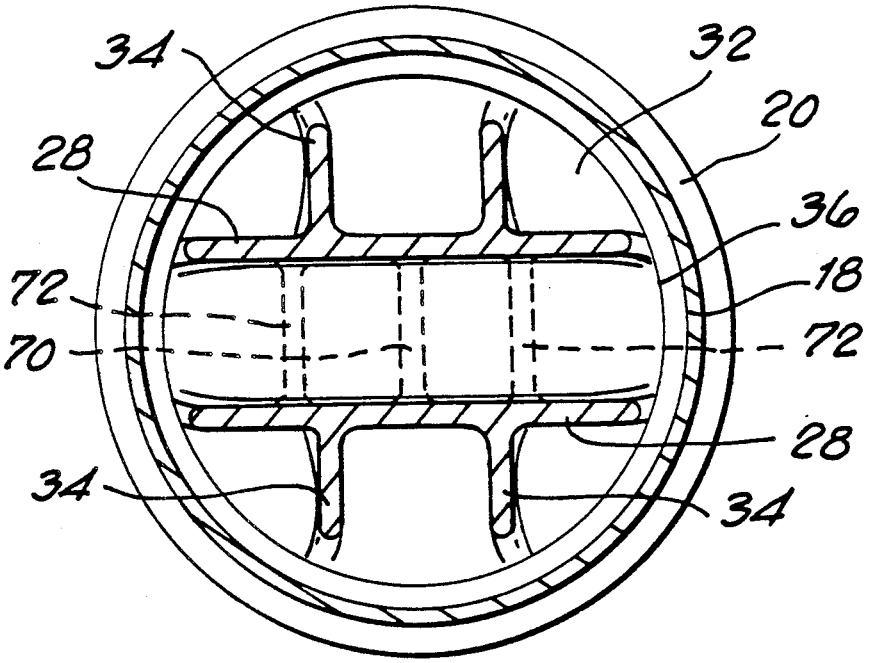
FIG. 2 shows a section through the piston of FIG. 1 on the line AA looking in the direction of the arrows.

Referring now to FIGS. 1 and 2 and where the same features are denoted by common reference numerals.

A piston is denoted generally at 10 and comprises a crown portion 12 and a separate articulated skirt portion 14. The crown portion 12 comprises a combustion bowl 16, ring belt 18 having piston-ring grooves 20 and which ring belt is in the form of an annular ring depending from the outer periphery 22 of the crown 24. Gudgeon pin bosses 26 are connected to the underside of the combustion bowl by planar webs 28 which at their upper ends 30 span and support the underside 32 of the combustion bowl. Extending substantially normally to the plane of the webs 28 and radially outwardly of them are two subsidiary planar support ribs 34 (shown as dashed lines in FIG. 1). The ribs 34 extend between the underside of the crown and the upper portion of the pin boss 26 and also, in the radial direction to the outer edge 36 of the combustion bowl underside. The crown portion 12 is a thin-walled, steel investment casting connected to the skirt portion 14, which is an aluminium alloy die casting, by a common gudgeon pin (not shown).

It should be noted that other constructions of articulated piston may employ a skirt portion made of a ferrous alloy.

Figure 3:
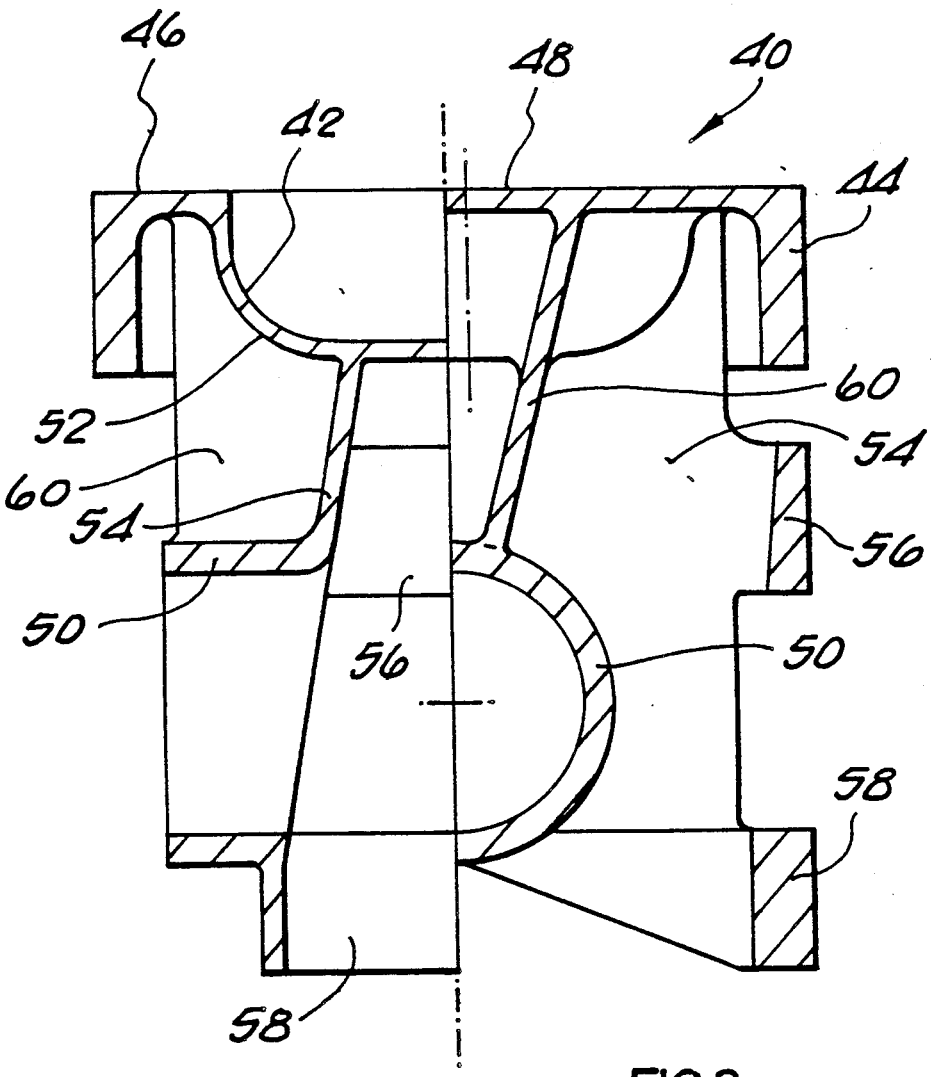
FIG. 3 which shows a section in two mutually perpendicular planes through a monometal piston according to the present invention.

FIG. 3 shows a piston 40 having a combustion bowl 42 and a ring belt 44 in the form of an annular ring depending from the outer periphery 46 of the crown 48. Gudgeon pin bosses 50 are connected to the under-side 52 of the combustion bowl by planar webs 54 which span and support the underside of the combustion bowl at their upper end. The webs 54 also extend radially to support skirt bearing lands 56 and 58 which accept piston side thrust loads. Extending between the bowl underside and the pin bosses and substantially normal to the plane of the webs 54 are ribs 60. The piston is formed as a thin-walled steel investment casting.

The webs 28, 54 and ribs 34, 60 provide rigid and light weight construction for a piston providing more uniform support of the crown and combustion bowl. The outer contact points of the webs and ribs with the crown are disposed in an even manner to provide more uniform support to the crown. Distortion of the piston crown and hence ring grooves in the ring belt during combustion is minimized. This leads to less uneven, localised loading of the pin bosses on the gudgeon pin and lower blow-by and oil consumption which improves emissions from the engine.

In some pistons an additional rib or ribs may be included depending from the combustion bowl underside and spanning the inner faces of the planar webs 28 . Such a single rib is shown as a dashed line 70 in FIGS. 1 and 2, or where more than one additional ribs are used, as dashed lines 72, showing two ribs disposed symmetrically about the plane which includes both the piston axis and the gudgeon pin axis. More than two ribs may be used if necessary.

In some pistons a single subsidiary support rib may be sufficient on each planar web. Such a rib may lie in the plane which includes the piston and gudgeon pin axes.

I claim:

1. A piston for an internal combustion engine, the piston comprising a crown having an associated piston ring groove belt and which crown is supported by gudgeon pin bosses connected thereto by two generally axially extending planar webs which are orientated transversely to the gudgeon pin axis and also supported by two subsidiary support ribs associated with each planar web and pin boss and which support ribs lie on the radially outer faces of said planar webs and extend in a generally axial direction from the crown underside and generally transversely to said planar webs.

2. A piston according to claim 1 wherein there is one axially extending rib lying in a plane which includes both the piston axis and the gudgeon pin axis and extends between said underside of the crown and the radially inner faces of said two planar webs.

3. A piston according to claim 1 wherein there are two generally axially extending ribs disposed about a plane which includes the piston axis and the gudgeon pin axis and which ribs extend between said underside of the crown and the radially inner faces of said two planar webs.

4. A piston according to claim 1 wherein said crown further includes a combustion chamber 5. A piston according to claim 1 wherein the piston is of articulated construction having a separate skirt portion connected to said crown by a common gudgeon pin.

6. A piston according to claim 1 wherein integral skirt lands are also included.

7. A piston according to claim 6 wherein said skirt lands are supported by lateral extensions of said planar webs.

8. A piston according to claim 1 wherein said crown, webs, support ribs and gudgeon pin bosses comprise a machined steel investment casting.

9. A piston according to claim 2 wherein said crown further includes a combustion chamber.

10. A piston according to claim 3 wherein said crown further includes a combustion chamber.

* * * * *